US010281849B2

(12) United States Patent
Ukai

(10) Patent No.: US 10,281,849 B2
(45) Date of Patent: May 7, 2019

(54) FIXING DEVICE AND IMAGE FORMING APPARATUS

(71) Applicant: Konica Minolta, Inc., Chiyoda-ku, Tokyo (JP)

(72) Inventor: Yuusuke Ukai, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/718,279

(22) Filed: Sep. 28, 2017

(65) Prior Publication Data

US 2018/0120740 A1 May 3, 2018

(30) Foreign Application Priority Data

Oct. 27, 2016 (JP) ..... 2016-210515

(51) Int. Cl.
*G03G 15/20* (2006.01)

(52) U.S. Cl.
CPC ..... *G03G 15/2017* (2013.01); *G03G 15/206* (2013.01); *G03G 15/2053* (2013.01)

(58) Field of Classification Search
None
See application file for complete search history.

(56) References Cited

U.S. PATENT DOCUMENTS 4,618,240 A * 10/1986 Sakurai ..... G03G 15/2053 219/216
2007/0059017 A1* 3/2007 Omura ..... G03G 15/5004 399/88
2015/0117881 A1* 4/2015 Murakami ..... G03G 15/2053 399/33
2015/0355587 A1* 12/2015 Tada ..... G03G 15/2064 399/329

FOREIGN PATENT DOCUMENTS

JP 2005049681 A * 2/2005
JP 2005049681 A * 2/2005
JP 2008-216444 A 9/2008

OTHER PUBLICATIONS

JP_2005049681_A_T Machine Translation Japan, Ikeda, Feb. 2005.*

* cited by examiner

*Primary Examiner* — Victor Verbitsky
(74) *Attorney, Agent, or Firm* — Buchanan Ingersoll & Rooney PC

(57) ABSTRACT

A fixing device includes a heating roller to be heated by a heat source, a pair of rollers composed of an upper-side pressure roller and a lower-side pressure roller both for pressing a sheet, and a fixing belt wound around the heating roller and the upper-side pressure roller, in which, in a space surrounded by the fixing belt, a shield for shielding heat from the upper-side pressure roller is disposed to face the upper-side pressure roller.

16 Claims, 12 Drawing Sheets

FIXING DEVICE AND IMAGE FORMING APPARATUS

CROSS REFERENCE TO RELATED APPLICATIONS

Japanese Patent Application No. 2016-210515, filed on Oct. 27, 2016, including description, claims, drawings, and abstract the entire disclosure is incorporated herein by reference in its entirety.

BACKGROUND

Technological Field

The present invention relates to a fixing device and an image forming apparatus.

Description of Related Art

An electrophotographic image forming apparatus that forms a toner image on a sheet (e.g., a copier, printer, facsimile or multifunctional peripheral thereof) conventionally includes a fixing device for heating to fix the toner image formed on the sheet. Although various types of fixing devices are present, a heating belt type fixing device including a heat fixing belt, such as the one disclosed in Japanese Patent Application Laid-Open No. 2008-216444, is advantageous for shortening a warming-up time, and the like.

Such a heating belt type fixing device requires a heat source for fixing a toner image on a sheet. There is a demand for not only a stable heat supply from the heat source, but also reduction of electric power consumption. In view of a demand for an energy saving standard for the whole of image forming apparatus in recent years, there is a larger demand for electric power saving in a fixing device which consumes most of the electric power for the whole apparatus.

SUMMARY

An object of the present invention is to provide a fixing device and an image forming apparatus that can reduce electric power consumption by increasing heat retention of a roller. The roller is one of rollers forming a nip for allowing a sheet to pass therethrough, and does not have a heat source.

To achieve at least one of the abovementioned objects, a fixing device reflecting one aspect of the present invention includes:

a heating roller to be heated by a heat source; a pair of rollers composed of an upper-side pressure roller and a lower-side pressure roller both for pressing a sheet; and a fixing belt wound around the heating roller and the upper-side pressure roller, in which, in a space surrounded by the fixing belt, a shield for shielding heat from the upper-side pressure roller is disposed to face the upper-side pressure roller.

An image forming apparatus reflecting another aspect of the present invention includes:

an image former for forming a toner image on a sheet, a fixer including a heating roller to be heated by a heat source, a pair of rollers composed of an upper-side pressure roller and a lower-side pressure roller both for pressing the sheet having the toner image thereon formed in the image former, and a fixing belt wound around the heating roller and the upper-side pressure roller, in which, the fixer further includes, in a space surrounded by the fixing belt, a shield, for shielding heat from the upper-side pressure roller, disposed to face the upper-side pressure roller.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
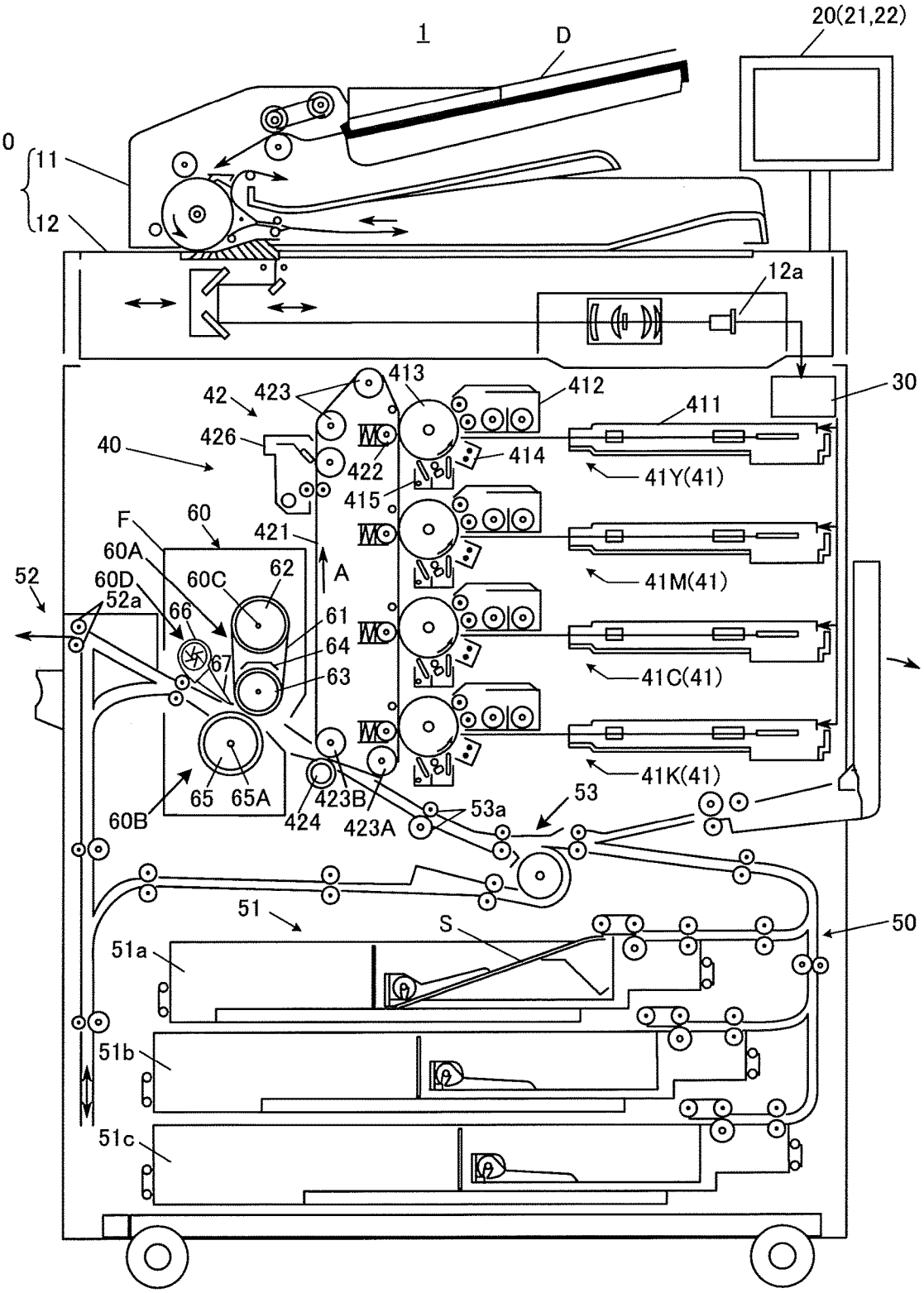
FIG. 1 schematically illustrates a whole configuration of an image forming apparatus according to an embodiment.
Figure 2:
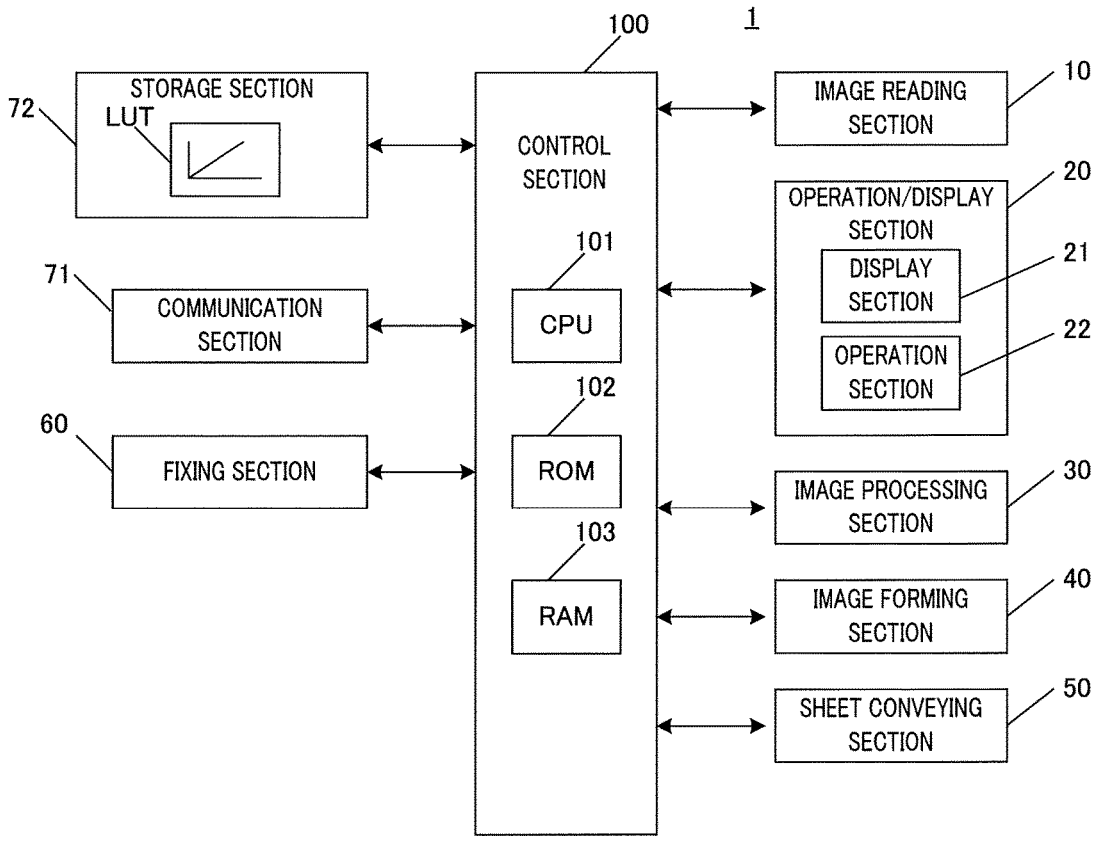
FIG. 2 illustrates a main section of a control system of the image forming apparatus according to the embodiment.

Hereinafter, the present embodiment will be described in detail with reference to the drawings. FIG. 1 schematically illustrates a whole configuration of image forming apparatus 1 according to the embodiment of the present invention. FIG. 2 illustrates a main section of a control system of image forming apparatus 1 according to the embodiment. Image forming apparatus 1 illustrated in FIGS. 1 and 2 is an intermediate transfer-mode color image forming apparatus utilizing electrophotographic process. Image forming apparatus 1 transfers color toner images of yellow (Y), magenta (M), cyan (C), and black (K) formed on respective photoconductor drums 413 to intermediate transfer belt 421 (primary transfer), superimposes the four color toner images on intermediate transfer belt 421, and then transfers the same to sheet S to form a toner image (secondary transfer).

Image forming apparatus 1 employs a tandem mode in which photoconductor drums 413 corresponding to respective four colors of Y, M, C, and K are disposed in series along the running direction of intermediate transfer belt 421, and color toner images are successively transferred to intermediate transfer belt 421 in a single procedure.

As illustrated in FIG. 2, image forming apparatus 1 includes image reading section 10, operation/display section 20, image processing section 30, image forming section 40, sheet conveying section 50, fixing section 60, control section 100 and the like.

Control section 100 includes central processing unit (CPU) 101, read-only memory (ROM) 102, random-access memory (RAM) 103, and the like. CPU 101 reads from ROM 102 a program corresponding to processing details, loads the program into RAM 103, and performs, cooperatively with the loaded program, centralized control of the operations in respective blocks of image forming apparatus 1. During this step, various data stored in storage section 72 are referred to. Storage section 72 is composed of, for example, a nonvolatile semiconductor memory (so-called flash memory) and/or a hard disk drive.

Control section 100 transmits and receives, via communication section 71, various data to and from an external apparatus (e.g., personal computer) connected to a communication network, such as a local area network (LAN) or a wide area network (WAN). Control section 100, for example, receives image data transmitted from the external apparatus, and operates to form a toner image on sheet S based on the image data (input image data). Communication section 71 is composed of, for example, a network interface card, such as a LAN card.

Image reading section 10 includes auto document feeder (ADF) 11, document image scanner 12 and the like.

Auto document feeder 11 conveys, with a conveying mechanism, document D placed on a document tray and sends the same to document image scanner 12. Auto document feeder 11 can continuously and simultaneously read images on multiple documents D (including images on both sides thereof) placed on the document tray.

Document image scanner 12 optically scans a document conveyed from auto document feeder 11 onto a contact glass or a document placed on a contact glass, and images light reflected from the document on a light receiving surface of charge coupled device (CCD) sensor 12*a* to read a document image. Image reading section 10 generates input image data based on results read with document image scanner 12. The input image data is subjected to predetermined image processing in image processing section 30.

Operation/display section 20 is composed of, for example, a touch panel-type liquid crystal display (LCD), and functions as both display section 21 and operation section 22. Display section 21 displays various operation screens, image conditions, operation conditions of each function, and/or the like in accordance with display control signals input from control section 100. Operation section 22 equipped with various operation keys, such as a numeric keypad and a start key, receives various input operation from users and outputs operation signals to control section 100.

Image processing section 30 includes, for example, a circuit that performs digital image processing of input image data in accordance with default settings or user settings. For example, image processing section 30 performs tone correction based on tone correction data (tone correction table) under the control of control section 100. In addition to tone correction, image processing section 30 also performs, for input image data, various correction processing, such as color correction or shading correction, compression processing, and/or the like. Image forming section 40 is controlled based on the processed image data.

Image forming section 40 includes, for example, intermediate transfer unit 42 and image forming units 41Y, 41M, 41C, and 41K for forming images with color toners of respective Y, M, C, and K components based on input image data.

Image forming units 41Y, 41M, 41C, and 41K for respective Y, M, C, and K components have similar configurations. For convenience in illustration and description, common components are denoted by the same numerals and such numerals are accompanied by Y, M, C, or K when they are to be distinguished. In FIG. 1, only components of image forming unit 41Y for Y component are denoted by numerals, and numerals are omitted for components of other image forming units 41M, 41C, and 41K.

Image forming unit 41 includes exposing device 411, developing device 412, photoconductor drum 413, charging device 414, drum cleaning device 415 and the like.

Photoconductor drum 413 is, for example, a negative-charging organic photoconductor (OPC) formed by successively laminating, on a peripheral surface of aluminum conductive cylinder (aluminum tube), an undercoat layer (UCL), a charge generation layer (CGL), and a charge transport layer (CTL). The charge generation layer is formed from an organic semiconductor composed of a charge generation material (e.g., phthalocyanine pigment) dispersed in a resin binder (e.g., polycarbonate), and generates pairs of positive charges and negative charges upon exposure using exposing device 411. The charge transport layer is formed from a hole transport material (electron-donating nitrogen compound) dispersed in a resin binder (e.g., polycarbonate), and positive charges generated in the charge generation layer are transported to a surface of the charge transport layer.

Control section 100 rotates photoconductor drum 413 at a constant peripheral speed by controlling driving current supplied to a driving motor (not shown) that rotates photoconductor drum 413.

Charging device 414 evenly and negatively charges the surface of photoconductive photoconductor drum 413. Exposing device 411 is composed of, for example, a semiconductor laser, and irradiates photoconductor drum 413 with laser beams corresponding to an image of a color component. Positive charges are thus generated in the charge generation layer of photoconductor drum 413, and transported to the surface of the charge transport layer, thereby neutralizing surface charges (negative charges) of photoconductor drum 413. As a result, electrostatic latent images of respective color components are formed on the surfaces of photoconductor drums 413, respectively, due to potential differences from the surroundings.

Developing device 412 is, for example, a developing device of a two-component developing system, and forms a toner image by attaching a toner of each color component to the surface of each photoconductor drum 413 to visualize the electrostatic latent image.

Drum cleaning device 415 includes a drum cleaning blade or the like to be slid on the surface of photoconductor drum 413, and removes residual toner remaining on the surface of photoconductor drum 413 after primary transfer.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is composed of an endless belt, and looped around the plurality of support rollers 423 under tension. At least one of the plurality of support rollers 423 is a driving roller, and the rest are driven rollers. For example, roller 423A, which is disposed downstream of primary transfer roller 422 for K component in the running direction of the belt, is preferably a driving roller. This facilitates the retention of a constant running speed of the belt in a primary transfer section. Intermediate transfer belt 421 runs in arrow A direction at a constant speed by the rotation of driving roller 423A.

Primary transfer roller 422 is disposed facing photoconductor drum 413 for each color component on the inner peripheral surface side of intermediate transfer belt 421. A primary transfer nip, for transferring a toner image to intermediate transfer belt 421 from photoconductor drum 413, is formed by firmly pressing primary transfer roller 422 on photoconductor drum 413 with intermediate transfer belt 421 therebetween.

Secondary transfer roller 424 is disposed on the outer peripheral surface side of intermediate transfer belt 421, opposite to backup roller 423B disposed on downstream of driving roller 423A in the running direction of the belt. A secondary nip, for transferring a toner image to sheet S from intermediate transfer belt 421, is formed by firmly pressing secondary transfer roller 424 on backup roller 423B with intermediate transfer belt 421 therebetween.

When intermediate transfer belt 421 passes through the primary transfer nip, toner images on photoconductor drums 413 are successively superimposed and transferred to intermediate transfer belt 421 (primary transfer). Specifically, primary transfer bias is applied to primary transfer roller 422 to impart an charge with polarity opposite to the toners to the rear surface side of intermediate transfer belt 421 (side in contact with primary transfer roller 422), thereby transferring the toner image to intermediate transfer belt 421 electrostatically.

Subsequently, during sheet S passing through the secondary transfer nip, the toner images on intermediate transfer belt 421 are transferred to sheet S (secondary transfer). Specifically, secondary transfer bias is applied to secondary transfer roller 424 to impart an charge with polarity opposite to the toners to the rear surface side of sheet S (side in contact with secondary transfer roller 424), thereby transferring the toner images to sheet S electrostatically. Sheet S bearing the transferred toner images is conveyed to fixing section 60.

Belt cleaning device 426 includes a belt cleaning blade or the like to be slid on the surface of intermediate transfer belt 421, and removes residual toner remaining on the surface of intermediate transfer belt 421 after the secondary transfer. In place of secondary transfer roller 424, a configuration in which a secondary transfer belt is looped around a plurality of support rollers including a secondary transfer roller under tension (so-called belt-type secondary transfer unit) may be employed.

Fixing section 60 includes upper-side fixing section 60A which includes a fixing surface-side member disposed on the fixing surface side of sheet S (toner image-formed surface), lower-side fixing section 60B which includes a rear surface-side support member disposed on the rear surface side of sheet S (surface opposite to the fixing surface), heating source 60C, and the like. A fixing nip, for gripping and conveying sheet S, is formed by firmly pressing the rear surface-side support member on the fixing surface-side member.

Fixing section 60 heats and presses conveyed sheet S on which the toner images have been transferred (secondary transfer) at the fixing nip, thereby fixing the toner images on sheet S. Fixing section 60 is disposed inside fixing device F as a unit. Inside fixing device F, also disposed is air separation unit 60D for separating sheet S from the fixing surface-side member by blowing air.

Sheet conveying section 50 includes sheet feeding section 51, sheet ejection section 52, conveying path section 53, and the like. Three sheet feeding tray units 51*a* to 51*c* which constitute sheet feeding section 51 store sheets S classified based on basis weight, size, and/or the like (standard paper, special paper) and in accordance with predetermined types. Conveying path section 53 includes a plurality of pairs of conveying rollers, such as registration roller pair 53*a*.

Sheets S stored in sheet feeding tray units 51*a* to 51*c* are each sent out from the topmost part and conveyed to image forming section 40 through conveying path section 53. During this step, a registration roller section where registration roller pair 53*a* is disposed corrects the tilt of sheet S fed and adjusts the timing of conveyance. The toner images on intermediate transfer belt 421 are then simultaneously transferred to one of the surfaces of sheet S in image forming section 40 (second transfer), and a fixing step is performed in fixing section 60. Sheet S bearing a formed image is ejected outside the apparatus using sheet ejection section 52 equipped with sheet ejection roller 52*a*.

A configuration of fixing section 60 as a fixing device will be described with reference to FIGS. 1 and 3.

Figure 3:
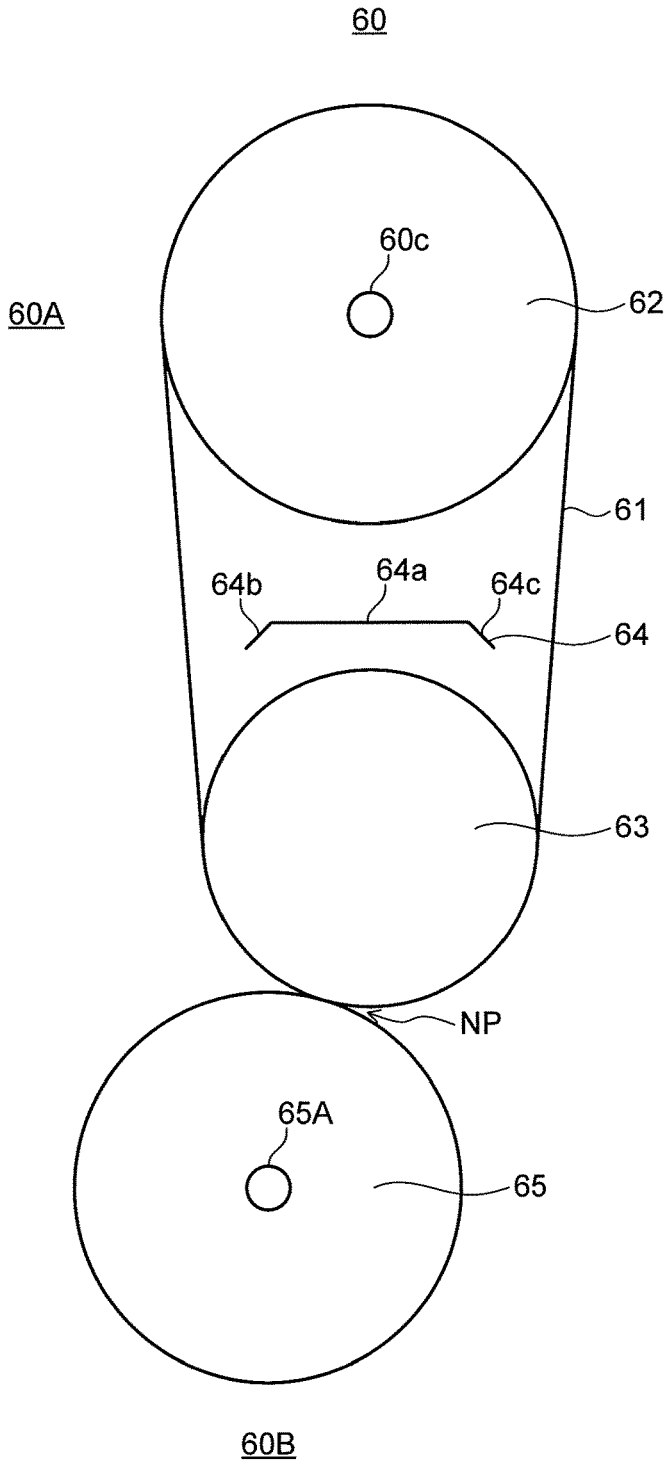
FIG. 3 illustrates a main section of a fixing device according to the embodiment.

As illustrated in FIGS. 1 and 3, upper-side fixing section 60A includes endless fixing belt 61, namely a fixing surface-side member, heating roller 61, upper-side pressure roller 63 and a shield member described below (belt-heating mode). Fixing belt 61 is looped around heating roller 62 and upper-side pressure roller 63 under a predetermined belt tension (e.g., 400N).

Fixing belt 61 is formed by, for example, covering the outer peripheral surface of a base made of PI (polyimide) with a heat-resistant silicon rubber as an elastic layer, and then covering or coating the surface layer with a PFA (perfluoroalkoxy) tube, which is a heat-resistant resin.

Fixing belt 61 contacts sheet S having a toner image formed thereon, and thermally fixes the toner image on sheet S at a temperature in a range allowing fixation. The range allowing fixation is a temperature range in which heat energy required for melting the toner on sheet S can be supplied, and varies depending on, e.g., the type of sheet S on which an image is to be formed.

Heating roller 62 applies heat to fixing belt 61. Heating roller 62 incorporates heating source 60C that heats fixing belt 61. Heating roller 62 is, for example, a halogen heater, and has a configuration in which the outer peripheral surface of a cylindrical mandrel made of aluminum or the like is covered with a resin layer coated with PTFE.

The temperature of heating source 60C is controlled by control section 100. Heating source 60C heats heating roller 62, and as a result, fixing belt 61 is heated.

Figure 4:
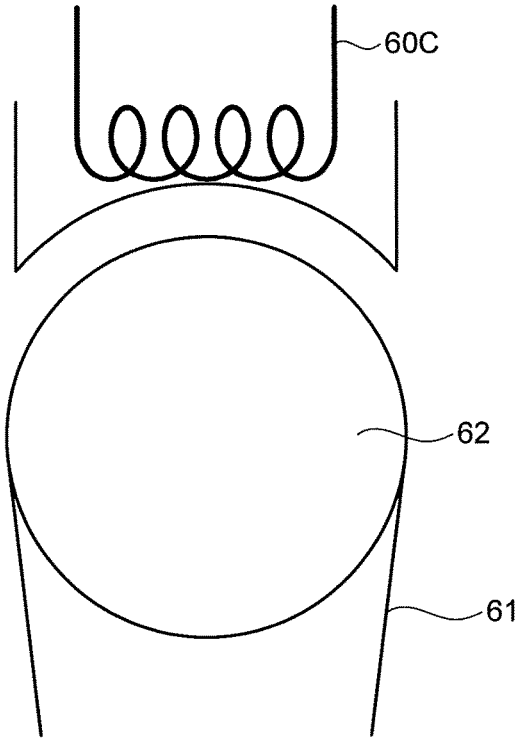
FIG. 4 illustrates another example of a disposed heat source in the fixing device.

In the present embodiment, heating source 60C is disposed inside heating roller 62, as described above. As another example of disposed heat source 60C, the heat source may be disposed outside heating roller 62 and fixing belt 61, as illustrated in FIG. 4.

Upper-side pressure roller 63 is formed by, for example, covering a solid mandrel formed of a metal such as iron with a heat-resistant silicon rubber as an elastic layer, and further covering the same with a resin layer coated with PTFE which is a heat-resistant resin with low friction. Upper-side pressure roller 63 is firmly pressed to lower-side pressure roller 65 with fixing belt 61 therebetween. A main driving source (not shown) in fixing section 60 drives rotation of lower-side pressure roller 65.

Lower-side fixing section 60B includes, for example, lower-side pressure roller 65 which is a rear surface-side support member (roller-pressing mode). Lower-side pressure roller 65 is formed by, for example, covering the outer peripheral surface of a base layer made of PI (polyimide) with a heat-resistant silicon rubber as an elastic layer, and further covering the outer peripheral surface of the elastic layer with a resin layer of a PFA tube as a surface releasing layer.

Control section 100 controls the main driving source (driving motor) to rotate lower-side pressure roller 65 in the counterclockwise direction in the drawings. The driving motor is driven and controlled (for example, turn on/off of rotation, circumferential velocity, and/or the like) by control section 100.

Lower-side pressure roller 65 incorporates heating source 65A, such as a halogen heater. Heat generated from this heating source 65A heats lower-side pressure roller 65. Control section 100 controls electric power supplied to heating source 65A, thereby controlling lower-side pressure roller 65 at a predetermined temperature.

Lower-side pressure roller 65 is firmly pressed to upper-side pressure roller 63 with fixing belt 61 therebetween under a predetermined fixing load. Fixing nip NP for gripping and conveying sheet S is formed between fixing belt 61 and lower-side pressure roller 65.

When lower-side pressure roller 65 rotates in the counterclockwise direction in the drawings, fixing belt 61 rotates in the clockwise direction in the drawings to follow the rotation of lower-side pressure roller 65. To follow this rotation, upper-side pressure roller 63 rotates in the clockwise direction in the drawings. Heating roller 62 rotates to follow the rotation in the clockwise direction in the drawings. During the fixation on sheet S, the circumferential speeds of fixing belt 61 and lower-side pressure roller 65 become substantially the same.

Air separation unit 60D includes air-blowing fan section 66 and air duct 67. Air separation unit 60D blows air from the sheet ejection side of fixing nip NP to fixing belt 61.

In fixing section 60, upper-side fixing section 60A, lower-side fixing section 60B and heat source 60C convey sheet S at fixing nip NP while heating and pressing sheet S, thereby fixing an unfixed toner image on sheet S. Air separation unit 60D (refer to FIG. 1) blows air to the head of sheet S passing through fixing nip NP to separate sheet S from fixing belt 61. This enables prevention of a winding jam and/or the like caused by sheet S, passing through fixing nip NP, having wound around the surface of fixing belt 61 and failed to separate therefrom.

Electric power saving, namely reduction of electric power consumption in fixing devices becomes a large technical challenge. For the above-mentioned heating belt type fixing device including a heat fixing belt, it is considered to be important to increase heat retention of a pair of rollers 63 and 65 forming fixing nip NP, particularly of upper-side pressure roller 63 having no heat source. Increasing heat retention of upper-side pressure roller 63 would contribute largely to reduction of electric power consumption, particularly during an idling state in which upper-side pressure roller 63 does not rotate, and heat from a fixing belt is not transferred.

In the present embodiment, heat retention of upper-side pressure roller 63 without a direct heat source is increased by disposing, above upper-side pressure roller 63, shield member 64 for shielding heat from upper-side pressure roller 63, as illustrated in FIG. 3. Hereinafter, such configuration will be described in detail.

In the present embodiment, shield member 64 is a plate-shaped member, and disposed in a space surrounded by fixing belt 61. Shield member 64 is disposed to face upper-side pressure roller 63.

More specifically, as illustrated in FIG. 3, shield member 64 includes central part 64*a* which is substantially linear in cross-section (i.e., flat plate-shaped), and end parts 64*b* and 64*c* each extending from either end of central part 64*a* in the shape of a flange, and inclining in the direction facing upper-side pressure roller 63. Central part 64*a* of shield member 64 is disposed in a substantially horizontal manner. The width of shield member 64 along the axial direction of upper-side pressure roller 63 (width in the longitudinal direction) is substantially the same as the width of upper-side pressure roller 63 in the axial direction.

The material of shield member 64 shields or blocks heat, in other words, prevents heat retained on one side (e.g., lower surface side) of shield member 64 from escaping to the other side (upper surface side). Therefore, as shield member 64, generally used various heat storage materials, heat insulating materials and reflecting materials may be used individually or in combination. Examples of combinations of a heat insulating material and another material will be described below.

According to shield member 64 in such a configuration, in a space on the lower surface side of shield member 64 and above upper-side pressure roller 63, heat from upper-side pressure roller 63 heated by fixing belt 61 and lower-side pressure roller 65 is retained, while heat directly radiated from heating roller 62 to upper-side pressure roller 63 is shielded. In the present embodiment, heat retention of upper-side pressure roller 63 can be increased by retaining heat in a space above upper-side pressure roller 63 and on the lower surface side of shield member 64 that faces upper-side pressure roller 63.

Therefore, according to the present embodiment, heat retention of upper-side pressure roller 63 can be increased during an idling state when heating roller 62 and fixing belt 61 do not rotate.

Figure 5:
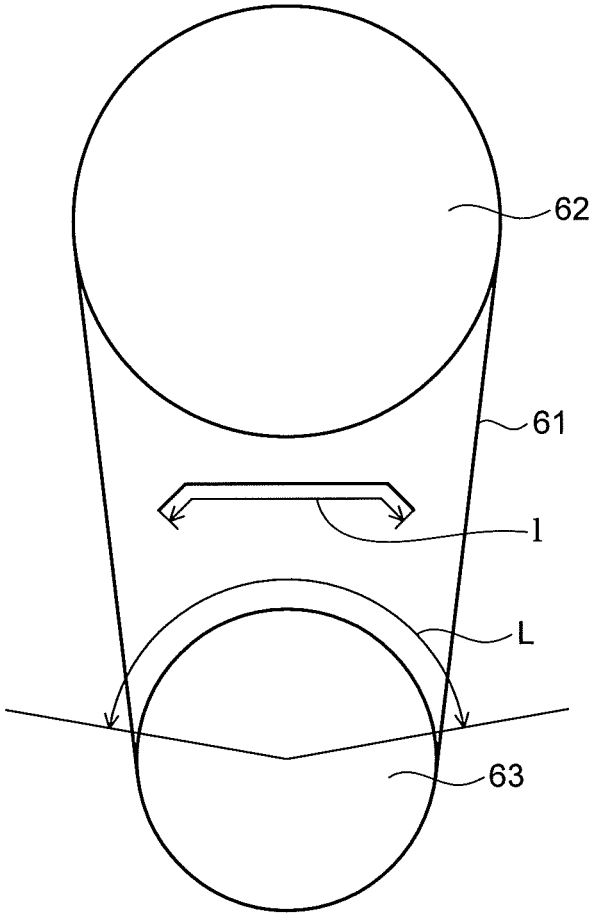
FIG. 5 explains the relationship between the length of a shield member and the arc length of an opened surface of an upper-side pressure roller.

FIG. 5 explains the relationship between length l of the shield member and arc length L of an opened surface of upper-side pressure roller 63. Length l of the shield member is the length along the arc of the surface of upper-side pressure roller 63 facing the shield member. In the example of FIG. 3, length l is the sum of the lengths of central part 64*a* and end parts 64*b* and 64*c* at either end thereof in shield member 64. Arc length L of the opened surface of upper-side pressure roller 63 is, as illustrated in FIG. 5, the arc length of a part where fixing belt 61 is not wound therearound.

For satisfactorily increasing heat retention of upper-side pressure roller 63, the relationship between length l of the shield member and arc length L of the opened surface of upper-side pressure roller 63 preferably satisfies the following expression 1:

$$l \geq L/2 \quad \text{(Expression 1).}$$

When expression 1 is not satisfied, that is, when length l of the shield member is shorter than L/2, the area covering the opened surface of upper-side pressure roller 63 becomes small, and satisfactory heat retention of upper-side pressure roller 63 cannot be obtained.

Hereinafter, modifications of the above-mentioned embodiment will be described. Configurations different from those of above-mentioned embodiment will be mainly described, and descriptions of configurations the same as those of the embodiment will be appropriately omitted.

Figure 6:
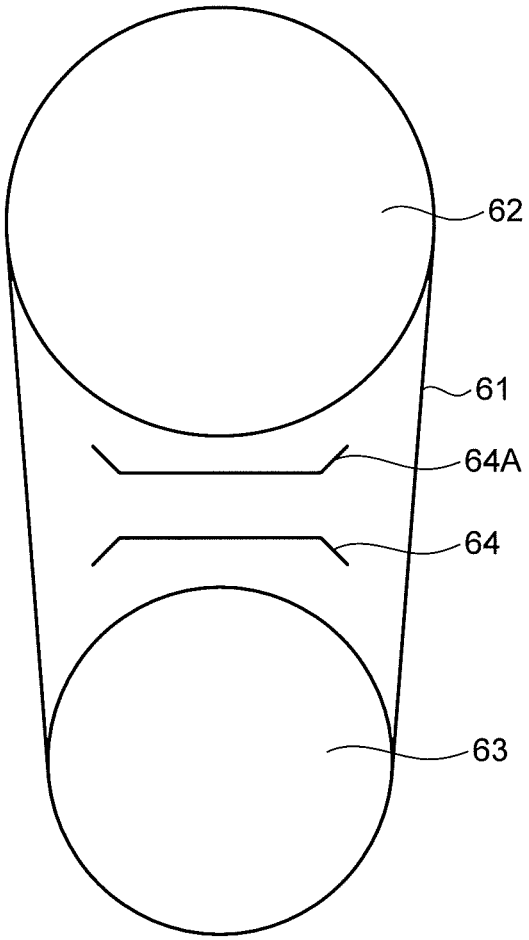
FIG. 6 illustrates a modification of the fixing device having two shield members.

FIG. 6 illustrates a modification of a fixing device having two shields. As obvious from comparison to FIG. 3, in the example of FIG. 6, shield member 64A as another (second) shield member is disposed above shield member 64 described in FIG. 3 and below heating roller 62. Shield member 64A has a shape substantially the same as shield member 64 described above, except that the direction of the end part is opposite to that of shield member 64. That is, shield member 64A includes end parts each extending from either end of a central part in the shape of a flange in substantially the same manner as in shield member 64, and is disposed to face heating roller 62. Other configurations of shield member 64A are the same as shield member 64 described above.

Shield member 64A is disposed to face heating roller 62 in the configuration illustrated in FIG. 6, and thus heat retention of heating roller 62 can also be increased in addition to the above-mentioned effect. Further, in the configuration illustrated in FIG. 6, shield member 64A retains heat of shield member 64 therebelow to increase heat retention of shield member 64 and a space therebelow, and as a result, heat retention of upper-side pressure roller 63 can be further increased.

Figure 7:
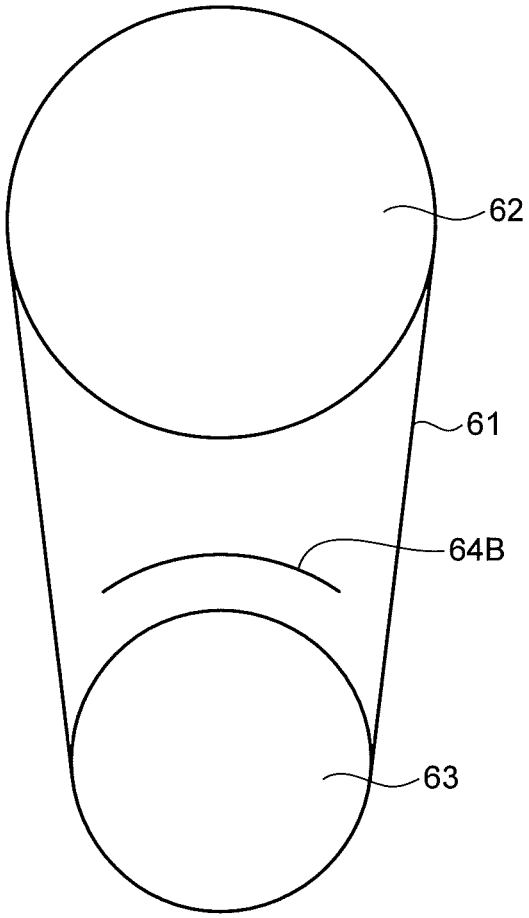
FIG. 7 illustrates another modification of the shield member in the fixing device.

FIG. 7 illustrates another modification of a shield in the fixing device. Shield member 64B illustrated in FIG. 7 has a uniform (substantially constant) distance between the surface facing upper-side pressure roller 63 and the surface of upper-side pressure roller 63. Specifically, shield member 64B is arc-shaped in cross-section in the example illustrated in FIG. 7. The configuration illustrated in FIG. 7 can obtain substantially the same effect as in the embodiment described in FIG. 3.

When upper-side pressure roller 63 is crown shaped, the shield member may have a corresponding shape, that is, a shape inclining from a central part in the axial direction, which has a uniform (substantially constant) distance from the surface of upper-side pressure roller 63.

Figure 8:
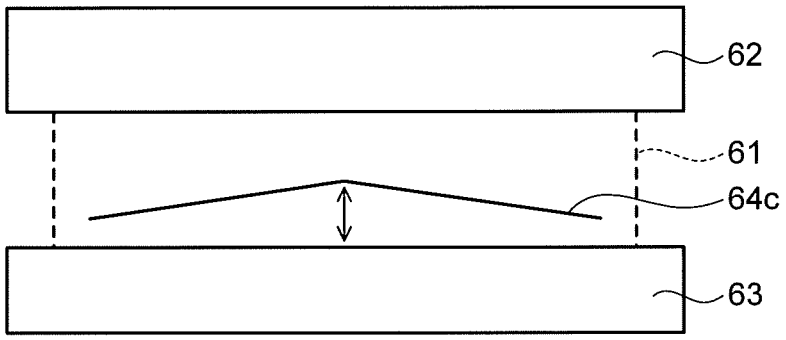
FIG. 8 illustrates yet another modification of the shield member in the fixing device.

FIG. 8 illustrates yet another modification of a shield member in the fixing device, and illustrates heating roller 62 and the like from the front. In FIG. 8, the ends of fixing belt 61 are shown with dotted lines. Such an example as in FIG. 8 has a structure in which heat is more likely radiated (heat is more likely to escape) from end part sides than from a central side in the axial direction of upper-side pressure roller 63, due to the fact that fixing belt 61 is not in contact with the end parts of upper-side pressure roller 63 in the axial direction.

In view of such a structure, shield member 64C illustrated in FIG. 8 has a shape inclining downward from a central part thereof correspondingly disposed to the center of upper-side pressure roller 63 in the axial direction. Therefore, the distance between shield member 64C and upper-side pressure roller 63 becomes shorter on the both end sides in the axial direction than on the central side. That is, the distance between shield member 64C and upper-side pressure roller 63 is shorter at either end part of upper-side pressure roller 63 than at the central part of upper-side pressure roller 63 both in the axial direction thereof. Such a configuration can keep effect of heat insulation and/or heat retention as constant as possible between parts of upper-side pressure roller 63 in the axial direction thereof.

Figure 9:
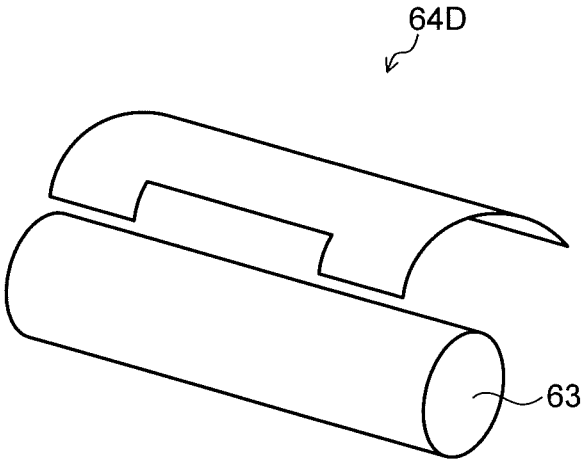
FIG. 9 illustrates yet another modification of the shield member in the fixing device.

FIG. 9 illustrates yet another modification of a shield member in the fixing device, which is a configuration example in view of the fact, as in FIG. 8, that heat radiation is higher at either end part than at the central part in upper-side pressure roller 63 in the axial direction. Shield member 64D illustrated in FIG. 9 has a shape on the basis of that of shield member 64B illustrated in FIG. 7. The area (width) is larger in the both end parts than in the central part in shield member 64D in the axial direction thereof. Such a configuration can also keep effect of heat insulation and/or heat retention as constant as possible between parts of upper-side pressure roller 63 in the axial direction thereof.

Figure 10A:
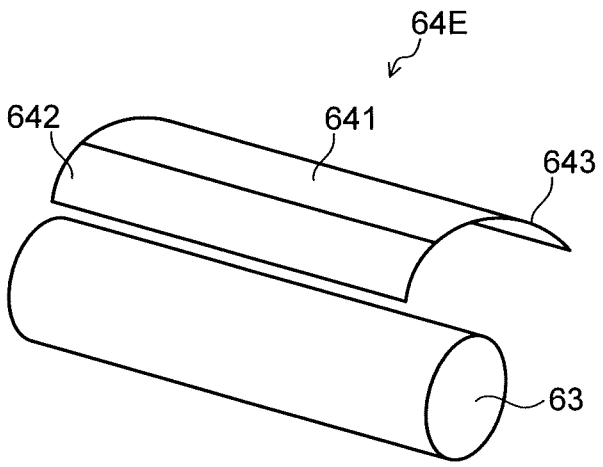
FIGS. 10A and 10B each illustrate yet another modification of the shield member in the fixing device, and an example in which reflecting materials are provided on both sides of a heat insulating material in the circumferential direction of the upper-side pressure roller in FIG. 10A, and in the axial direction thereof in FIG. 10B.
Figure 10B:
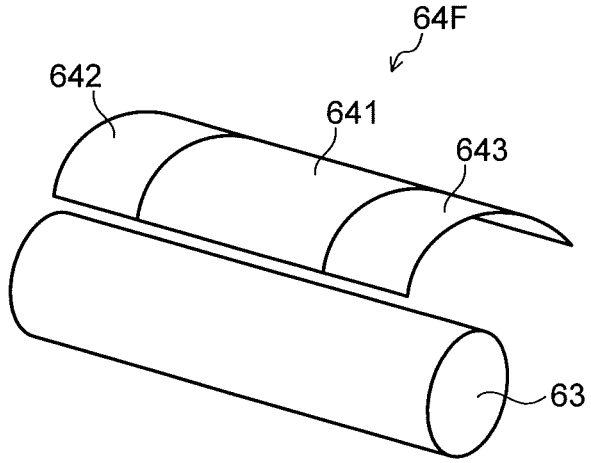

FIGS. 10A and 10B each illustrate yet another modification of a shield member in the fixing device. FIG. 10A illustrates shield member 64E in which members having different properties are disposed along the circumferential direction of upper-side pressure roller 63, and FIG. 10B illustrates shield member 64F in which members having different properties are disposed along the axial direction of upper-side pressure roller 63.

In shield member 64E illustrated in FIG. 10A, heat insulating material 641 is provided in a central part along the circumferential direction of upper-side pressure roller 63, and reflecting materials 642 and 643 are provided so as to extend from either end of heat insulating material 641. Such a configuration enables reflecting materials 642 and 643 to reflect radiant heat from upper-side pressure roller 63, and upper-side pressure roller 63 to absorb the reflected radiant heat at corresponding parts. Therefore, the configuration can keep effect of heat insulation and/or heat retention as constant as possible between parts of upper-side pressure roller 63 facing shield member 64E in the circumferential direction of the roller.

In shield member 64F illustrated in FIG. 10B, heat insulating material 641 is provided in a central part along the axial direction of upper-side pressure roller 63, and reflecting materials 642 and 643 are provided so as to extend from either end of heat insulating material 641. Such a configuration enables reflecting materials 642 and 643 to reflect radiant heat from upper-side pressure roller 63, and upper-side pressure roller 63 to absorb the reflected radiant heat at corresponding parts. Therefore, the configuration can keep effect of heat insulation and/or heat retention as constant as possible between parts of upper-side pressure roller 63 facing shield member 64F in the axial direction of the roller.

Figure 11A:
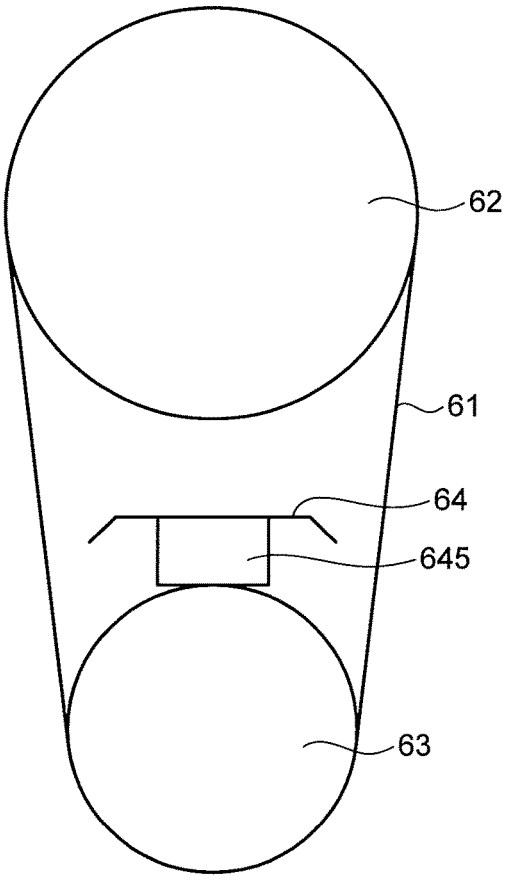
FIGS. 11A and 11B each illustrate yet another modification of the shield member in the fixing device, and an example in which an elastic member is attached to the lower surface of a central part of the shield member in FIG. 11A, and to the upper surface thereof in FIG. 11B.
Figure 11B:
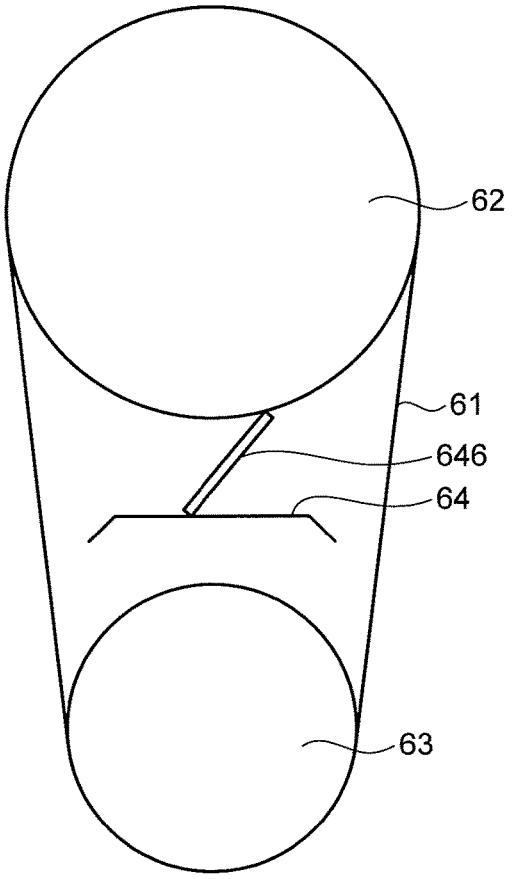

FIGS. 11A and 11B each illustrate yet another modification of a shield member in the fixing device, which is a configuration example in which an elastic member is attached to the shield member, and the elastic member is in contact with a constituting member of upper-side fixing section 60A. In the example of FIG. 11A, elastic member 645 which is rectangular in cross-section (i.e., prism shaped) is attached to the lower surface of the central part of shield member 64, and the surface (lower surface) of elastic member 645 is in contact with upper-side pressure roller 63. In the example of FIG. 11B, plate-shaped elastic member 646 is attached to the upper surface of the central part of shield member 64, and the head (edge) of elastic member 646 is in contact with heating roller 62 to press heating roller 62. Although not illustrated, another configuration is possible, such that a plate-shaped elastic member is attached to shield member 64 and the head of the elastic member is in contact with the inner surface of fixing belt 61 to press fixing belt 61.

In such a configuration, not only can shield member 64 increase the heat retention of upper-side pressure roller 63, the elastic member provided on shield member 64 can remove a foreign matter attached to a constituting member of upper-side fixing section 60A and clean the same. Alternatively, the contact state of the elastic member to the constituting member of upper-side fixing section 60A can be adjusted, or, as necessary, a brake can be applied on the constituting member of upper-side fixing section 60A, for, e.g., stabilizing the rotation of a roller, by combining with a configuration of FIG. 12A described below.

Figure 12A:
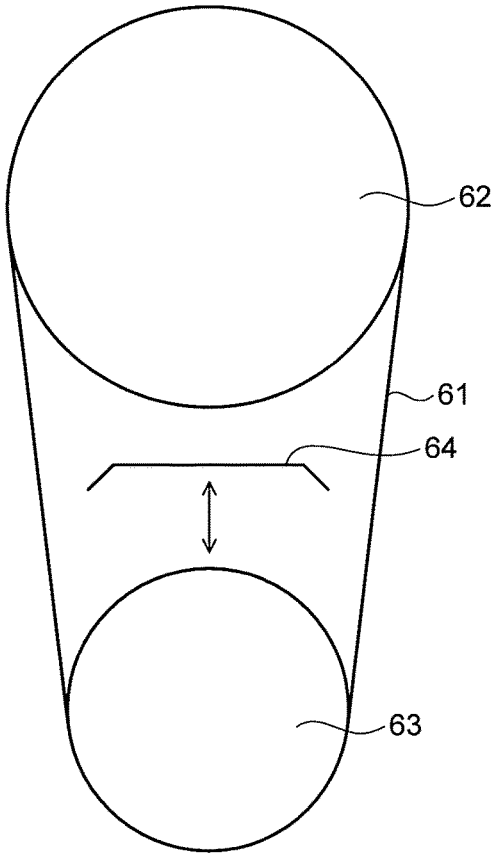
FIGS. 12A and 12B each illustrate yet another modification of the shield member in the fixing device, and an example in which the shield member is provided to be movable in the separating/approaching direction to/from the upper-side pressure roller in FIG. 12A, and provided in an openable manner in FIG. 12B.
Figure 12B:
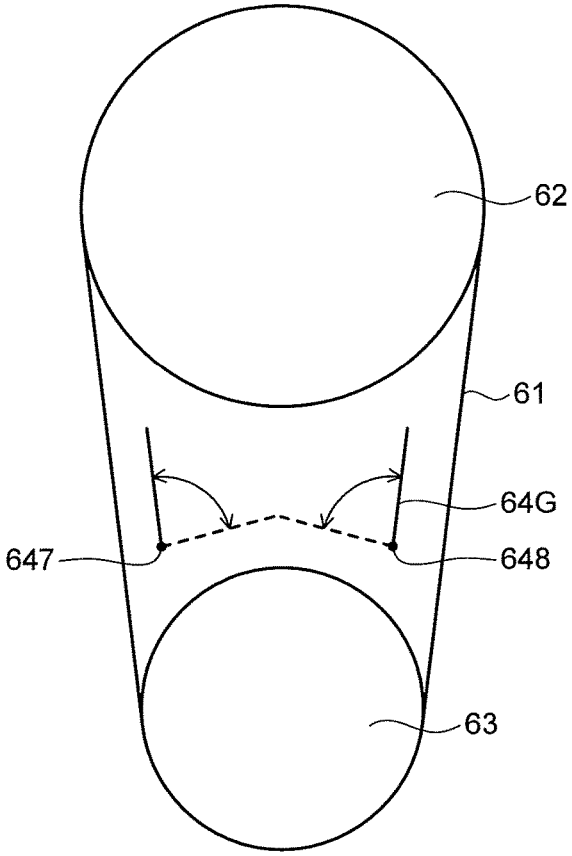

FIGS. 12A and 12B are examples in which a shield member is provided to be movable. FIG. 12A illustrates a configuration in which shield member 64 moves vertically, that is, in the direction approaching to or separating from upper-side pressure roller 63. FIG. 12B illustrates shield member 64G provided in an openable manner with axes 647 and 648 as pivot points.

In the example of FIG. 12A, a shield member is connected to an actuator (not illustrated), and control section 100 drives the actuator to move the shield member between a lower position where heat shielding effect is maintained, and an upper position where heat shielding effect is reduced. FIG. 12A illustrates shield member 64 of FIG. 3 as an example; however, shield members 64B to 64F and the like according to the above-mentioned modifications can be provided as movable.

In the example of FIG. 12B, shield member 64G is connected to an actuator (not illustrated), and control section 100 drives the actuator to open or close shield member 64 in the arrow direction in the drawing, that is, in the direction approaching to or separating from upper-side pressure roller 63 with axes 647 and 648 provided at either end of the shield member as pivot points. By this opening and closing, shield member 64G is moved from a position where heat shielding effect of upper-side pressure roller 63 is maintained (position shown with a dotted line in the drawing) to a position shown with a solid line in the drawing.

Such configurations of FIGS. 12A and 12B can release heat from upper-side pressure roller 63 by moving the shield member to a position where heat shielding effect is reduced when cooling of upper-side pressure roller 63 is necessary, for example.

According to the present embodiment, heat retention of an upper-side pressure roller can be increased by disposing a shield member for shielding heat from a upper-side pressure roller to face the upper-side pressure roller in a space surrounded by a fixing belt, thereby reducing electric power consumption of a fixing device, and eventually of the whole of image forming apparatus.

Although embodiments of the present invention have been described and illustrated in detail, it is clearly understood that the same is by way of illustration and example only and not limitation, the scope of the present invention should be interpreted by terms of the appended claims.

What is claimed is:

1. A fixing device comprising:

a heating roller to be heated by a heat source;

a pair of rollers composed of an upper-side pressure roller and a lower-side pressure roller both for pressing a sheet; and a fixing belt wound around the heating roller and the upper-side pressure roller, wherein, in a space surrounded by the fixing belt, a shield for shielding heat from the upper-side pressure roller is disposed to face the upper-side pressure roller, wherein the shield is formed from at least one of:

(1) a heat storage material;

(2) a heat insulating material; or (3) a reflecting material and the heat insulating material, wherein the shield includes, along an axial direction of the upper-side pressure roller, a central part and an end side, and wherein a first width, along a circumferential direction of the upper-side pressure roller, of the shield at the end side of the shield is larger than a second width, along the circumferential direction of the upper-side pressure roller, of the shield at the central part of the shield.

2. The fixing device according to claim 1 further comprising:

another shield being disposed to face the heating roller.

3. The fixing device according to claim 1, wherein the heat source is disposed inside the heating roller or outside the fixing belt.

4. The fixing device according to claim 1, wherein the central part of the shield is substantially linear in cross-section, and an end part of the shield extends from the central part and inclines in a direction facing the upper-side pressure roller.

5. The fixing device according to claim 1, wherein a cross section of the shield is an arc corresponding to a cross section of the upper-side pressure roller.

6. The fixing device according to claim 1, wherein the shield is disposed at an intermediate position in a space between the heating roller and the upper-side pressure roller.

7. The fixing device according to claim 5, wherein the fixing device has a uniform distance between the shield and the upper-side pressure roller.

8. The fixing device according to claim 5, wherein the upper-side pressure roller includes, along the axial direction of the upper-side pressure roller, a central part and an end part; and a first distance between the shield and the upper-side pressure roller at the end part of the upper-side pressure roller is shorter than a second distance between the shield and the upper-side pressure roller at the central part of the upper-side pressure roller.

9. The fixing device according to claim 1 further comprising:

an elastic material attached to the shield, wherein the elastic material is in contact with the heating roller, the upper-side pressure roller, or an inner surface of the fixing belt.

10. The fixing device according to claim 9, wherein the shield presses the elastic body to the heating roller, the upper-side pressure roller, or the inner surface of the fixing belt.

11. The fixing device according to claim 9, wherein the elastic material is a plate-shaped material, and the shield brings an edge of the plate-shaped material into contact with the heating roller, the upper-side pressure roller, or the inner surface of the fixing belt.

12. The fixing device according to claim 9, wherein the elastic material is configured to be capable of separating from or approaching to the heating roller, the upper-side pressure roller, or the inner surface of the fixing belt.

13. The fixing device according to claim 1, wherein the shield is configured to be movable relative to the upper-side pressure roller.

14. The fixing device according to claim 13, wherein the shield is configured to be movable relative to the upper-side pressure roller, to a position where heat shielding effect is reduced.

15. The fixing device according to claim 1, wherein the shield and the upper-side pressure roller satisfy expression 1 below:

$$l \geq L/2 \quad \text{(Expression 1)}$$

wherein l is a total length of a surface of the upper-side pressure roller, and L is a total arc length of a part of the upper-side pressure roller which does not contact the fixing belt.

16. An image forming apparatus comprising:

an image former for forming a toner image on a sheet, and a fixer including a heating roller to be heated by a heat source, a pair of rollers composed of an upper-side pressure roller and a lower-side pressure roller both for pressing the sheet having the toner image thereon formed in the image former, and a fixing belt wound around the heating roller and the upper-side pressure roller, wherein the fixer further includes, in a space surrounded by the fixing belt, a shield for shielding heat from the upper-side pressure roller, the shield being disposed to face the upper-side pressure roller, and wherein the shield is formed from at least one of:

(1) a heat storage material;

(2) a heat insulating material; or (3) a reflecting material and the heat insulating material, wherein the shield includes, along an axial direction of the upper-side pressure roller, a central part and an end side, and wherein a first width, along a circumferential direction of the upper-side pressure roller, of the shield at the end side of the shield is larger than a second width, along the circumferential direction of the upper-side pressure roller, of the shield at the central part of the shield.

* * * * *